US012618253B2

(12) United States Patent
Jones

(10) Patent No.: US 12,618,253 B2
(45) Date of Patent: May 5, 2026

(54) CLEANING ACCESSORY

(71) Applicant: MY POOL SUPPLY, LLC, Layton, UT (US)

(72) Inventor: Jennifer Jones, Layton, UT (US)

(73) Assignee: MY POOL SUPPLY, LLC, Layton, UT (US)

( * ) Notice: Subject to any disclaimer, the term of this patent is extended or adjusted under 35 U.S.C. 154(b) by 342 days.

(21) Appl. No.: 18/107,242

(22) Filed: Feb. 8, 2023

(65) Prior Publication Data

US 2024/0263477 A1 Aug. 8, 2024

(51) Int. Cl.
*E04H 4/16* (2006.01)

(52) U.S. Cl.
CPC ..... *E04H 4/169* (2013.01)

(58) Field of Classification Search
CPC ..... E04H 4/169
See application file for complete search history.

(56) References Cited

U.S. PATENT DOCUMENTS

| | | | | |
|---|---|---|---|---|
| 4,247,216 | A * | 1/1981 | Pansini | B25G 3/18 403/324 |
| 5,133,503 | A * | 7/1992 | Giordano | E04H 4/1618 134/167 R |
| 7,328,473 | B2 * | 2/2008 | Deklinski | E04H 4/1636 15/1.7 |
| 8,771,435 | B2 * | 7/2014 | Graffius | B08B 3/02 134/166 R |
| 2004/0158943 | A1 * | 8/2004 | Popielarczyk | E04H 4/1618 15/1.7 |
| 2006/0085929 | A1 * | 4/2006 | Deklinski | E04H 4/1636 210/167.16 |
| 2024/0263477 | A1 * | 8/2024 | Jones | E04H 4/169 |

* cited by examiner

*Primary Examiner* — Marc Carlson
(74) *Attorney, Agent, or Firm* — Timothy A. Hodgkiss; Buckingham, Doolittle & Burroughs, LLC

(57) ABSTRACT

A cleaning accessory for use in cleaning debris from the bottom of a pool, such as a swimming pool, includes a tapered nozzle inlet and a nozzle outlet that are fluidly coupled together by a nozzle cavity. The nozzle outlet is configured to be attached to a vacuum by a flexible hose. The body also includes an attachment cavity for attachment to a pole member. As such, the cleaning accessory allows a user to stand near the edge of the pool while controlling the movement of the nozzle inlet to vacuum debris that has accumulated in an area between the pool's bottom and sidewall.

16 Claims, 12 Drawing Sheets

CLEANING ACCESSORY

TECHNICAL FIELD

The various embodiments disclosed herein relate to accessories for cleaning pools containing water, such as swimming pools. Particularly, the various embodiments disclosed herein relate to a pool cleaning accessory that is configured for attachment to a vacuum hose and a user-controlled pole. More particularly, the various embodiments disclosed herein relate to a cleaning accessory having a tapered nozzle inlet for cleaning debris that has collected on the bottom of the floor of the pool, particularly at the area between the pool's floor and side wall.

BACKGROUND

Swimming pools are a source of exercise, enjoyment, and relaxation for many, whether it is swimming itself, water sports, or simply wading in the water. However, because pools are not often constructed within enclosed structures, they are exposed to the outdoor environment. Thus, environmental debris, such as tree leaves and needles, dirt, sand, and trash, often finds its way into the exposed pool water. While pools typically have a filtration system that functions to circulate and filter water in the pool, the pool's filtration system is limited to filtering debris that is suspended in the circulating water itself. Thus the heavier debris, such as dirt and sand particles, as well as leaves saturated by water, that falls to the bottom of the pool to its floor cannot be captured by the pool's filtration system. As a result, this debris remains trapped on the pool's floor and diminishes the attractiveness and aesthetic beauty of the water in the pool. In some cases, this accumulated debris may cause the pool's water to become unsanitary for its users. In addition, the disintegrated leaves, dirt, and other particulates may become agitated by the feet of the pool's users, which can enter and irritate their eyes when they are using the pool. Thus, the debris trapped at the bottom of the pool is a frustration that many pool owners unfortunately have to endure.

In an attempt to clean the debris that has collected on the floor of the pool, various vacuuming devices have been developed. These pool vacuuming devices are designed to be submerged into the pool's water and ride and move around upon the floor of the pool. As the vacuuming device moves, it applies a suction force to pull the debris thereon, whereupon it is pulled into an inlet and resultantly routed through an exhaust hose where it is captured by a filtration system. While these pool vacuums are effective for cleaning the generally horizontally extending surface of the pool's floor, they are ineffective for cleaning debris that accumulates at the transition area between the pool floor and the side wall of the pool, which is angled or curved. That is, given the design of the pool vacuum, it is unable to apply suitable suction force to the curved, contoured, or angled transition region that generally exists between the pool side wall and the pool floor. As a result of this ineffectiveness in cleaning, this transition area that generally extends around the perimeter of the pool's floor continues to include collected debris, which reduces the attractiveness of the pool, while potentially making the pool's water unsanitary and unsafe for its users, as previously discussed.

Therefore, it would be desirable to provide a pool cleaning accessory that is configured to be utilized to clean debris captured at the transition area between the pool's floor and the pool's side wall. In addition, it would be desirable to provide a pool cleaning accessory that is capable of being removably attached to an elongated pole to allow a user of the accessory to stand on the decking surface that extends about the perimeter of the opening of the pool to move the pool cleaning accessary as necessary. Furthermore, it would be desirable to provide a pool cleaning accessory that is capable of being removably attached to a hose-connected filtration system to remove the debris captured at the transition area between the pool's floor and the pool's side wall. Still yet, it would be desirable to provide a pool cleaning accessory that includes a nozzle inlet having a tapered shape. In addition, it would be desirable to provide a pool cleaning accessory that includes a nozzle inlet having a tapered nozzle cavity.

SUMMARY

In light of the foregoing, it is a first aspect of the various embodiments disclosed herein to provide a cleaning accessory comprising a body having a nozzle inlet and a nozzle outlet that are fluidly coupled by a nozzle cavity, and an attachment segment extending from the body.

Yet another aspect of the various embodiments disclosed herein is to provide an unassembled cleaning accessory kit comprising a body having a nozzle inlet and a nozzle outlet that are fluidly coupled by a nozzle cavity; an attachment segment extending from the body; and an attachment collar adapted to be attached at one end to a hose and the attachment collar being configured to be selectively attached at another end to the outlet nozzle, such that the hose is placed into fluid communication with the nozzle cavity.

BRIEF DESCRIPTION OF THE DRAWINGS

The various embodiments disclosed herein will become better understood with regard to the following description, accompanying drawings, and claims wherein:

DETAILED DESCRIPTION

Figure 1:
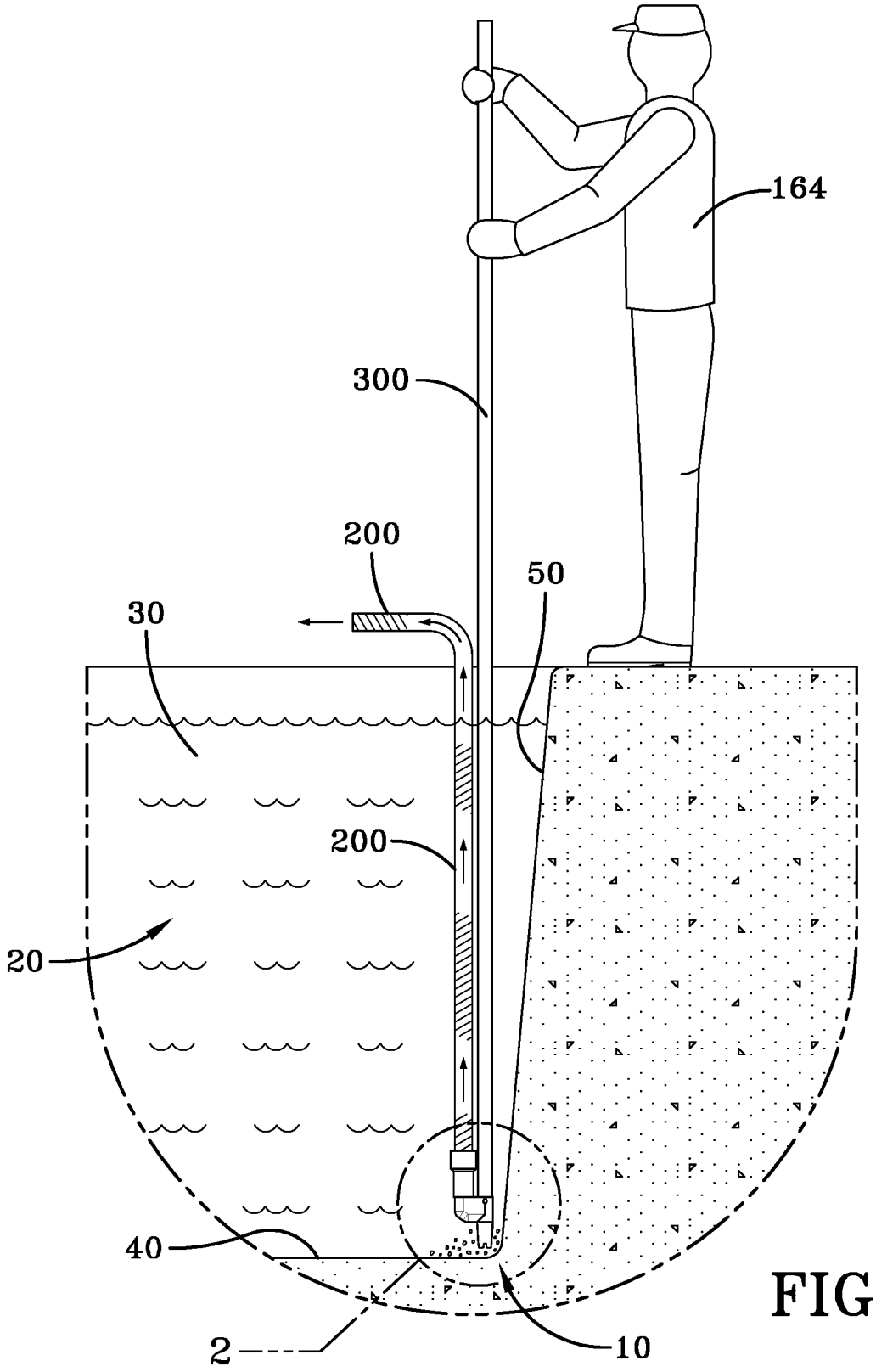
FIG. 1 is an elevational view showing a cleaning accessory being used to clean debris from a pool in accordance with the various embodiments disclosed herein.
Figure 2:
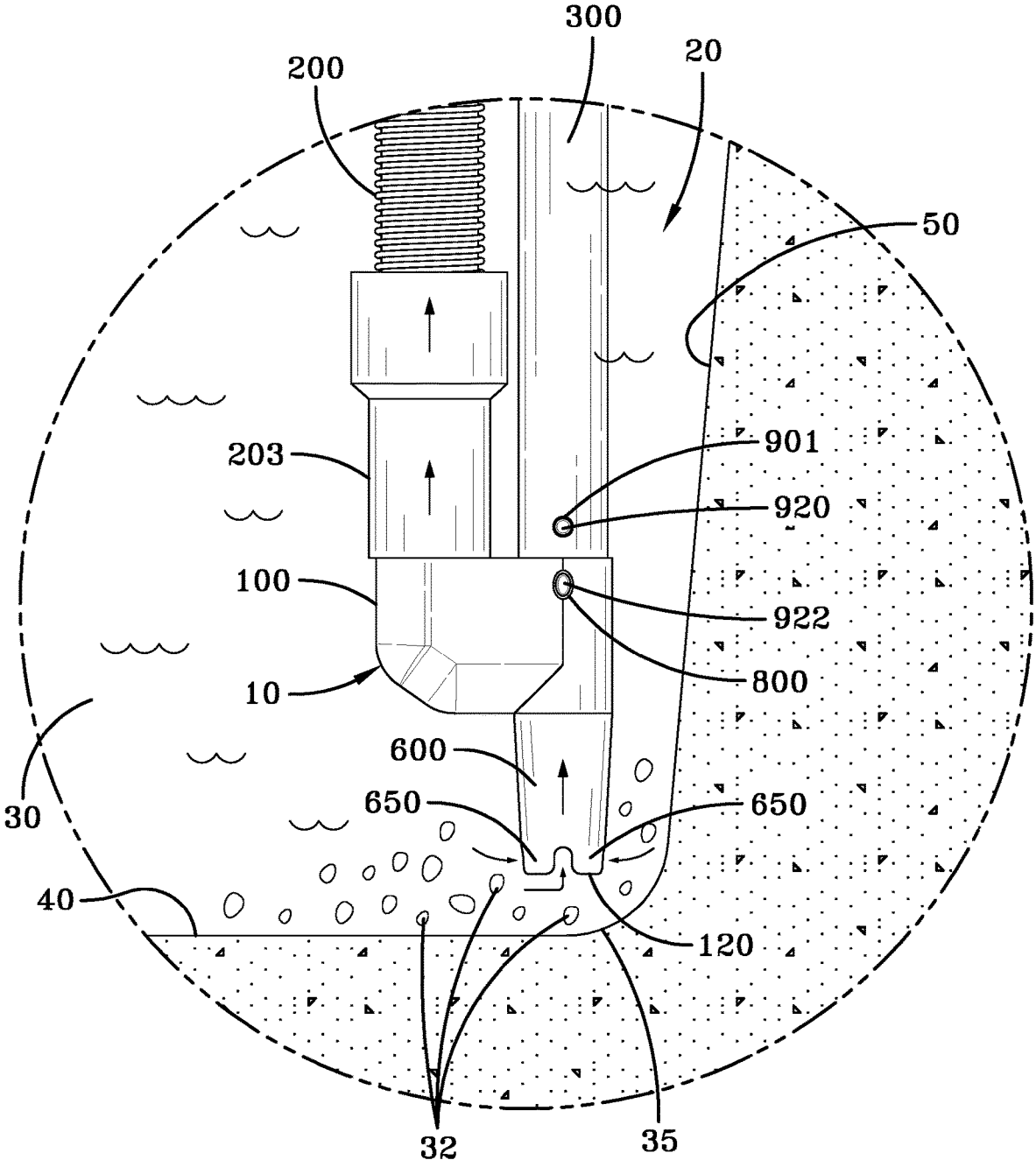
FIG. 2 is an inset view of FIG. 1 showing the cleaning accessory being used to clean debris from the pool in accordance with the various embodiments disclosed herein.

The various embodiments disclosed herein relate to a cleaning accessory 10, which is utilized to clean debris from a pool, such as swimming pools 20, as shown in FIGS. 1 and 2. Thus, while the cleaning accessory 10 may be utilized in connection with cleaning swimming pools, it may also be utilized with any other type of enclosure that retains a liquid, such as water 30, in which debris may collect. In particular, the cleaning accessory 10 may be utilized for cleaning debris 32 that collects in an area 35 that is between a floor 40 and a side wall 50 of the pool 20. The cleaning accessory 10 includes a body 100 having a nozzle inlet 120 and a nozzle outlet 140 that are fluidly coupled together. In addition, the body 100 includes an attachment cavity 160. Thus, during use of the cleaning accessory 10, the nozzle outlet 140 is operatively coupled to a vacuum hose 200 that is provided by any suitable vacuum system. In addition, the attachment cavity 160 is configured to be selectively attached to an elongated pole or other elongated member 300. Thus, without having to enter into the water of the pool, a user 164 of the cleaning accessory 10 is able to stand near the perimeter of the pool 20 and guide the nozzle inlet 120 to vacuum the debris 32 that is on the pool floor 40.

Figure 3:
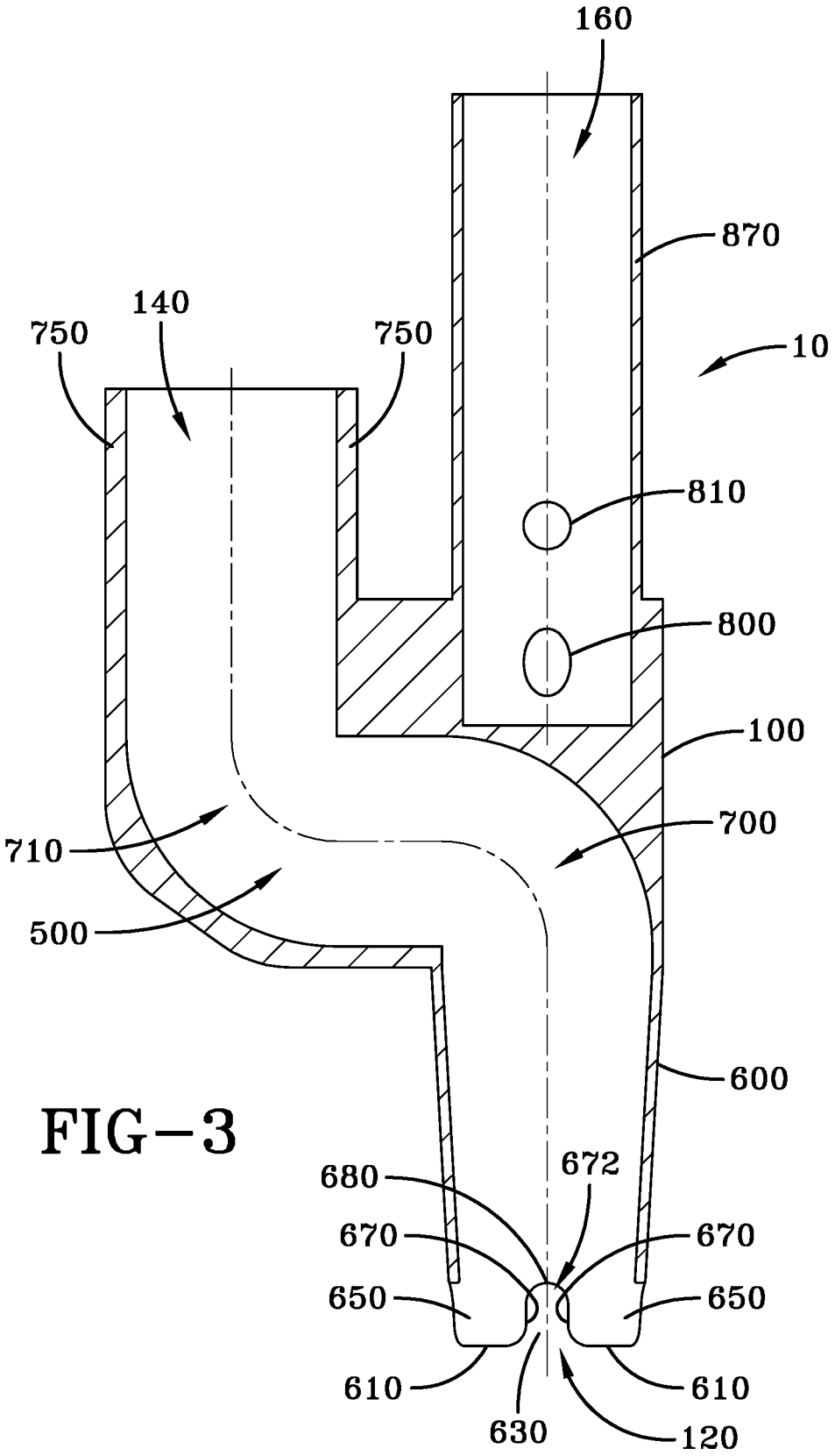
FIG. 3 is a cross-sectional view of the cleaning accessory in accordance with the various embodiments disclosed herein.
Figure 4:
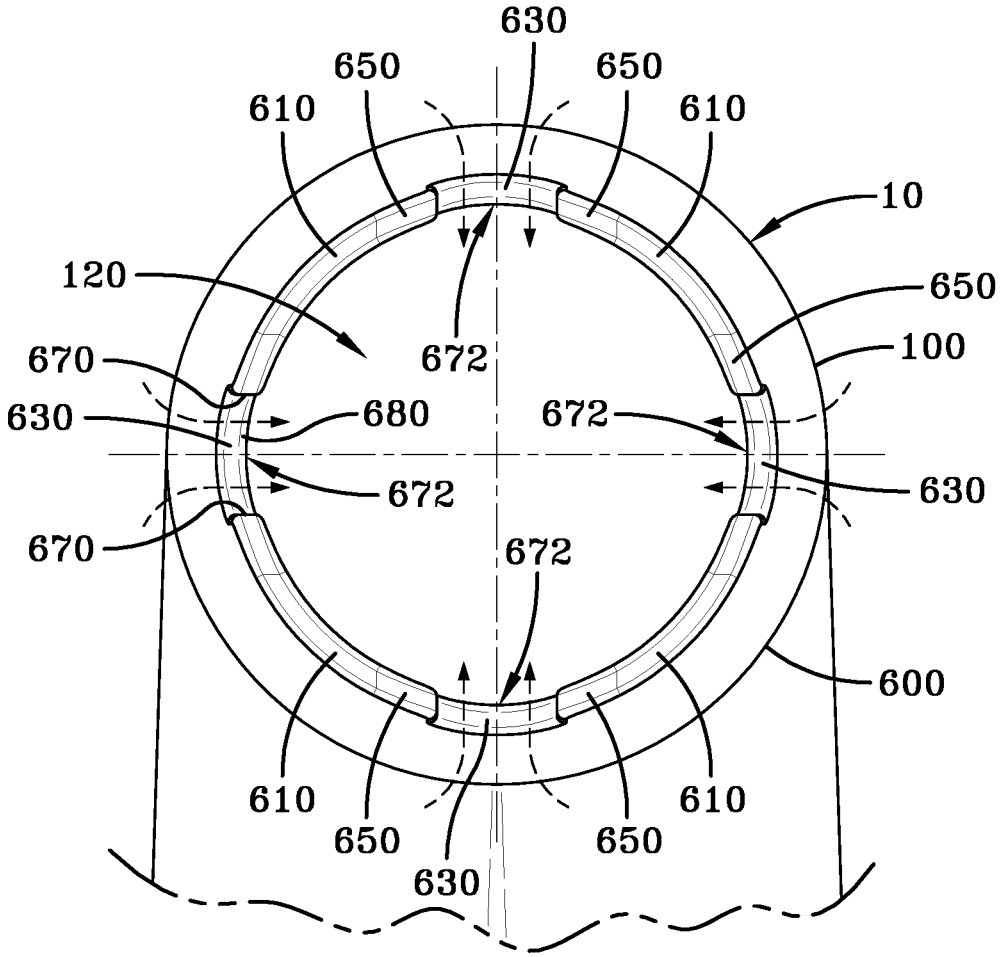
FIG. 4 is a top plan view of the nozzle inlet of the cleaning accessory in accordance with the various embodiments disclosed herein.
Figure 5:
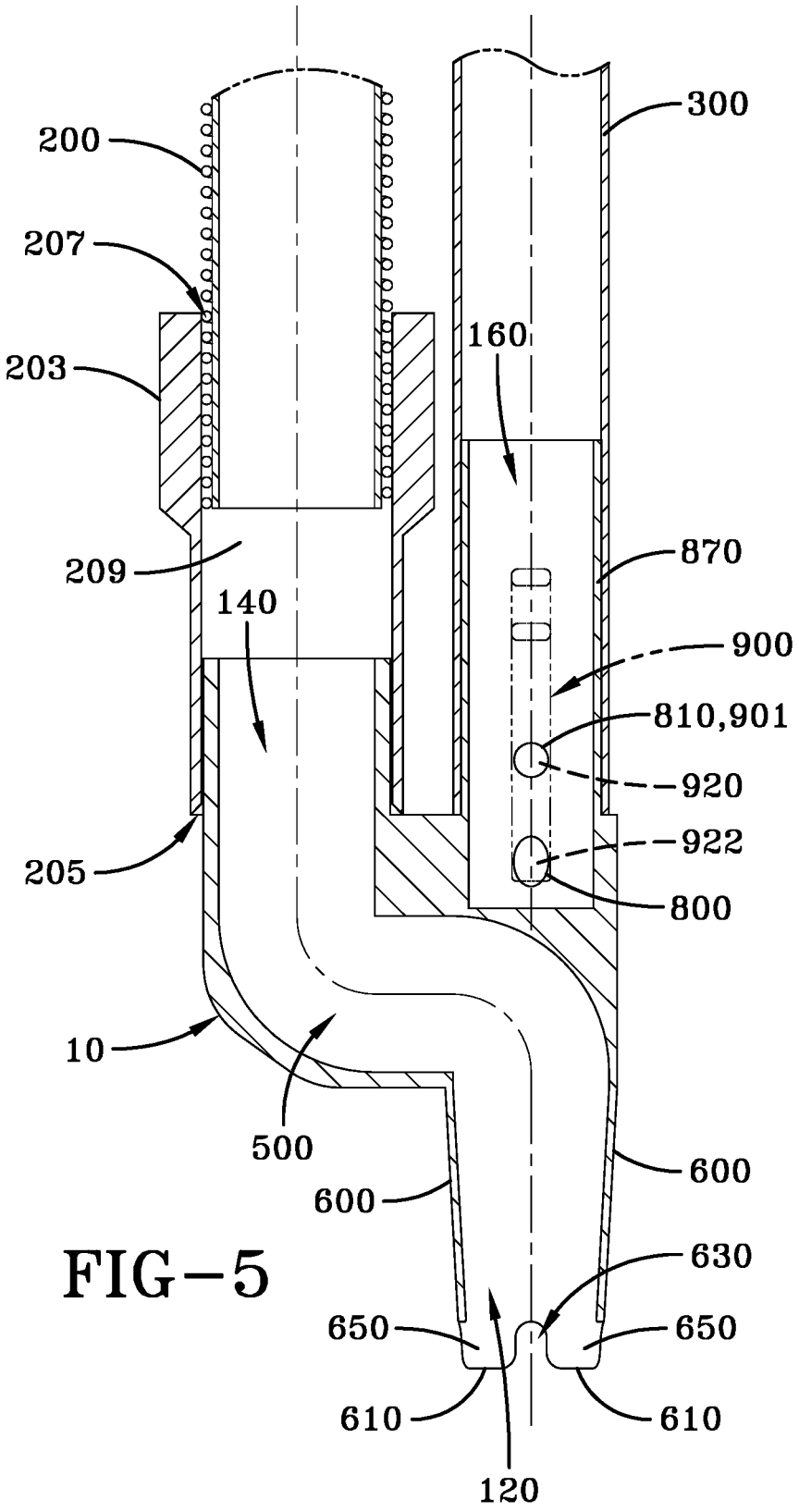
FIG. 5 is a cross-sectional view of the cleaning accessory attached to a vacuum hose and a pole member in accordance with the various embodiments disclosed herein.

Specifically, as shown in FIG. 3, the cleaning accessory 10 includes the body 100, which provides the nozzle inlet 120 and the nozzle outlet 140, which are fluidly coupled together by nozzle cavity 500, as shown in FIGS. 3 and 4. It should be appreciated that the body 100 may be formed of any suitable material, such as metal, plastic, composite and the like, as well as combinations thereof. The nozzle outlet 140 may have any suitable cross-sectional shape, such as a curvilinear shape or a rectilinear shape or a combination thereof. For example, in some embodiments, the nozzle outlet 140 may be formed to have an annular shape, as shown in the FIGS. The nozzle outlet 140 is configured to be placed in fluid connection with the vacuum hose 200 through any suitable means of attachment. For example, in some embodiments, the nozzle outlet 140 may be configured to be attached to the vacuum hose 200 by friction fit, snap fit, threaded fit, or any other suitable means of attachment. In addition, in other embodiments, the vacuum hose 200 may be selectively attached to the nozzle outlet 140 by a fitting or adapter 203, as shown in FIG. 5. The fitting 203 includes an inlet 205 and an outlet 207 that are fluidly coupled by a cavity 209. The inlet 205 and outlet 207 may have any suitable cross-sectional shape, such as a curvilinear shape, a rectilinear shape, or a shape that is a combination thereof. Thus, the inlet 205 of the fitting or adapter 203 is configured to be fluidly coupled to the nozzle outlet 140 by friction it, snap fit, threaded fit, or any other suitable means of attachment. The inlet 205 of the fitting 203 may be attached to the inner or outer surface forming the nozzle outlet 140. In addition, the hose 200 may be selectively and fluidly coupled to the outlet 207 of the fitting 203 by friction it, snap fit, threaded fit, or any other suitable means of attachment. The vacuum hose 200 may be attached to the inner or outer surface forming the outlet 207 of the fitting 203.

As shown in FIG. 5, the inlet 205 of the adapter 203 is friction fit about the outer circumference of the nozzle outlet 140. In addition, the outer circumference of the vacuum hose 200 is friction fit within the inner circumference of the outlet 207 of the adapter 205.

As previously discussed, the vacuum hose 200 is also attached at its other end to a suitable vacuum system (not shown) that creates a vacuum force at the nozzle inlet 120. This allows the cleaning accessory 10 to vacuum the debris 32 that has collected at the bottom of the pool 20 at a point or area 35 proximate to the transition between the horizontal pool floor 40 and the vertically extending side walls 50 of the pool. It should be appreciated that the floor 40 and side walls 50 of the pool 20 may be arranged at any curve, radius, or angle, and as such, may be arranged as a rectilinear orientation, curvilinear orientation, and a combination thereof.

Continuing, the portion of the body 100 including the nozzle inlet 120 includes a tapered section 600, which extends to a nozzle edge 610 that defines the opening of the nozzle inlet 120. Thus, the outer periphery/diameter of the tapered section 600 of the body 100 that is proximate to the nozzle inlet 120 is smaller than the outer periphery/diameter of the tapered section 600 that is distal to the nozzle inlet 120, as shown in FIGS. 2 and 3. It should also be appreciated that in some embodiments, the diameter/periphery of the nozzle cavity 500 that is proximate to the nozzle inlet 120 is smaller than the diameter/periphery of the nozzle cavity 500 that is distal to the nozzle inlet 120, as shown in FIGS. 3 and 5. It should be appreciated that the inner and outer periphery of the tapered section 600 may be any suitable cross-sectional shape, including a rectilinear shape, a curvilinear shape or a combination of both.

The tapered section 600 provides the nozzle edge 610 that includes one or more recessed passages 630, as shown in FIGS. 3, 4, 9 and 10. It should be appreciated that the recessed passages 630 may have any suitable shape, such as a rectilinear shape, a curvilinear shape or a combination thereof. For example, as shown in FIGS. 3 and 4, the recessed passages 630 are defined by two spaced apart substantially parallel edges 670 to form a gap 672. In addition, the parallel edges 670 are joined together at one end by a curved edge 680.

Furthermore, in the case of the use of multiple recessed passages 630, such passages 630 are spaced apart by nozzle members 650, whereby the nozzle members 650 form the edge 610 of the nozzle inlet 120. It should also be appreciated that the edges 610 of the nozzle members 650 may be curved, as shown in FIG. 4, such that when they are taken together, the nozzle members 650 define the nozzle inlet 120 as a substantially annular opening. However, it should be appreciated that the nozzle members 650 may be configured as rectilinear members, curvilinear members, or a combination thereof. As such, the nozzle inlet 120, as well as the passages 630, are configured to be placed proximate to the debris 32 that is collected in the area 35 that is between the floor 40 and the side wall 50 of the pool 20.

Continuing, the nozzle cavity 500, shown in FIG. 3, fluidly couples the nozzle inlet 120 to the nozzle outlet 140. In some embodiments, the nozzle cavity 500 may include one or more substantially right angle bends or turns. For example, the nozzle cavity 500 may include two substantially right angle bends 700 and 710. However, it should be appreciated that the nozzle cavity 500 may be configured to have any number of bends, contours, or shapes. It should also be appreciated that the cross-sectional shape of the nozzle cavity 500 may be rectilinear, curvilinear, or a combination of both. For example, the nozzle cavity 500 may be substantially annular in shape as shown in the FIGS. It should also be appreciated that the nozzle inlet 120 and the nozzle outlet 140 may be spaced apart or offset by any suitable distance. In other words, the longitudinal axis of the nozzle inlet 120 and the longitudinal axis of the nozzle outlet 140 may be spaced apart by any suitable distance.

In addition, in some embodiments, the nozzle inlet 120 and the nozzle outlet 140 are positioned to open in opposite directions from one another. However, it should be appreciated that the nozzle inlet 120 and the nozzle outlet 140 may open in any desired orientation, such as opening in the same direction or in directions that are at substantially right angles to each other, for example. For example, the nozzle inlet 120 and the nozzle outlet 140 may be configured so that their axial centers/longitudinal axes are parallel with each other, such as that shown in FIG. 3, however, they may be arranged at any desired angle to each other.

Figure 6:
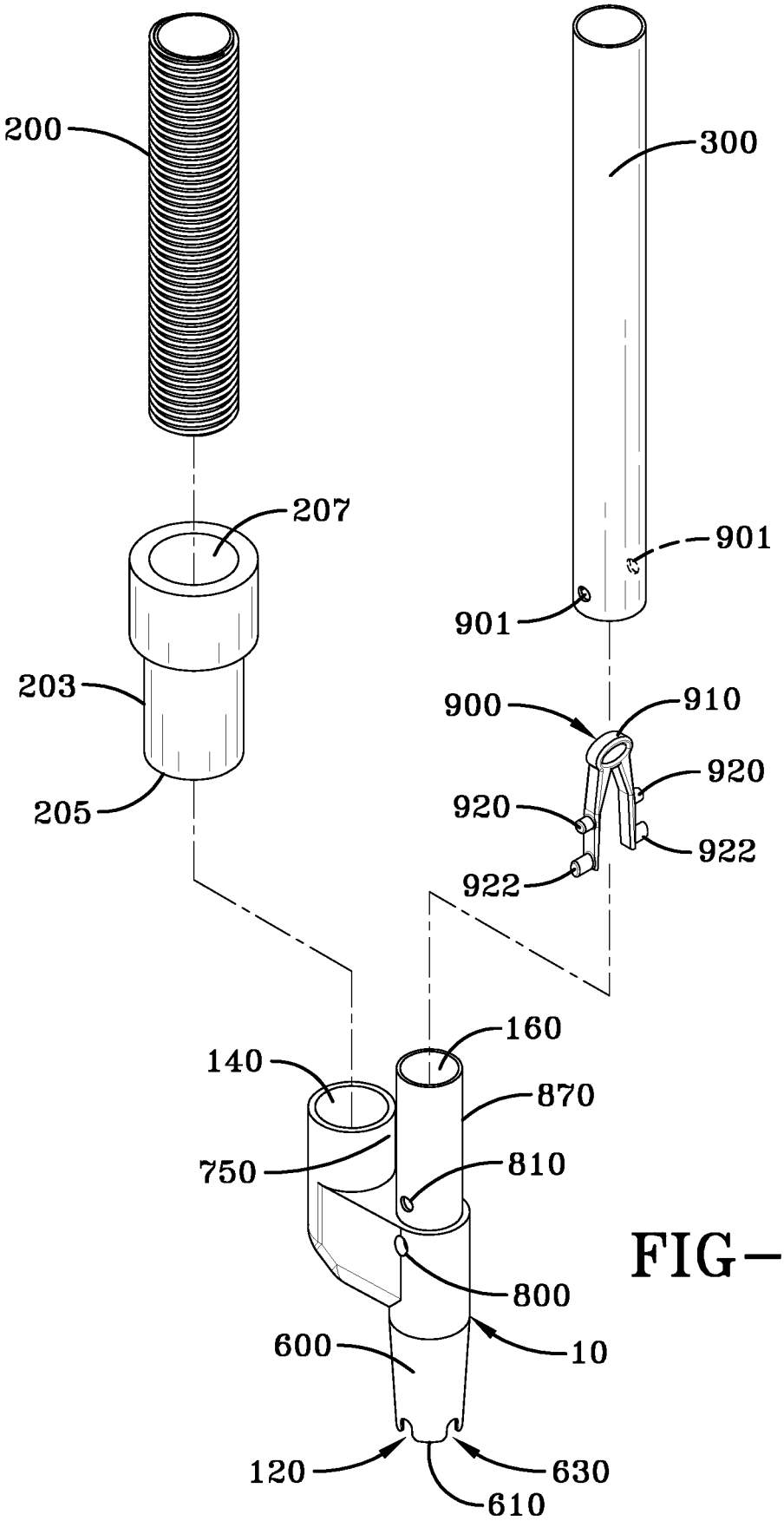
FIG. 6 is an exploded view of the cleaning accessory showing an attachment fitting used to attach the vacuum hose and the pole member in accordance with the various embodiments disclosed herein.

In some embodiments, the nozzle outlet 140 may include an elongated attachment segment 750 that extends from the body 100 of the cleaning accessory 10, as shown in FIG. 3. The attachment segment 750 may have any suitable cross-sectional shape, such as a rectilinear shape, a curvilinear shape, or a combination of both. In addition, the attachment segment 750 may extend from the body 100 at any desired angle. The attachment segment 750 is configured so that it extends so as to be parallel to the tapered section 600. However, it should be appreciated that the attachment segment 750 and the tapered section 600 may be oriented, such that their longitudinal axes are parallel to each other, but may be arranged at any desired angle to each other. In addition, the attachment segment 750 is configured so that in some embodiments, it can be fluidly coupled with the fitting 203 for attachment of the vacuum hose 200, as shown in FIGS. 5-6. The vacuum hose 200 is configured to also be attached to the vacuum system (not shown) so that the debris 32 that is collected by the nozzle inlet 120 from the pool 20 is captured and removed therefrom.

The body 100 of the accessory 10 also includes the attachment cavity 160 that is defined by an attachment segment 870. The attachment cavity 160 may have any desired cross-sectional shape, such as a rectilinear shape, a curvilinear shape, or a combination of both. As shown in FIGS. 3 and 5, the attachment cavity 160 may be substantially annular. Disposed in the wall of the attachment segment 870 are lock apertures 800 and 810. It should be appreciated that the lock apertures 800 and 810 are configured as sets of two apertures that are positioned and disposed in the body 100 so that they are opposite to each other, as shown in the FIGS. However, it should be appreciated that only one lock aperture 800 and one lock aperture 810 may be used. Continuing, in some embodiments, the attachment cavity 160 is configured to receive the pole member 300 therein. It should be appreciated that the pole member 300 may comprise one or more elongated sections, which may be selectively attached together using any suitable means of fixation, such as friction fit or threaded fit for example. In addition, the pole member 300 includes one or more attachment apertures 901, which in some embodiments are arranged opposite to each other. Furthermore, the pole member 300 may be formed of a plurality of members that are attached together so as to be telescopically extended. In some embodiments, the pole member 300 may be secured within the attachment cavity 160, such as through friction fit, compression fit, threaded fit, or the like. Alternatively, the pole member 300 may be adhesively attached to the attachment cavity 160. Furthermore, the pole member 300 may be secured within the attachment cavity 160 by one or more threaded fasteners that are received through the lock apertures 800,810 and into the pole member 300 or into the attachment aperture 901 disposed in the pole member 300.

Figure 9:
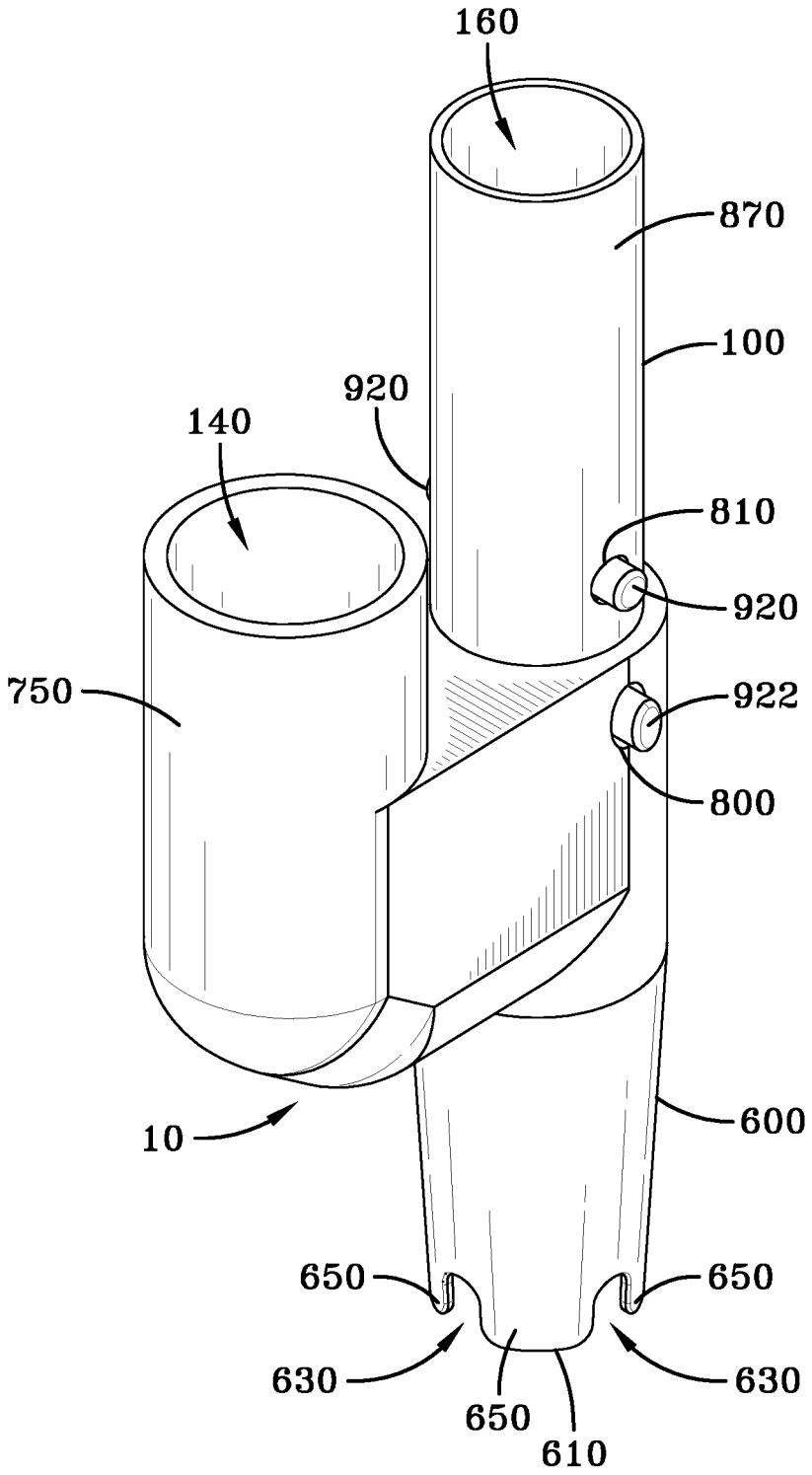
FIG. 9 is a perspective view of the cleaning accessory showing the lock member carried therein in accordance with the various embodiments disclosed herein.
Figure 10:
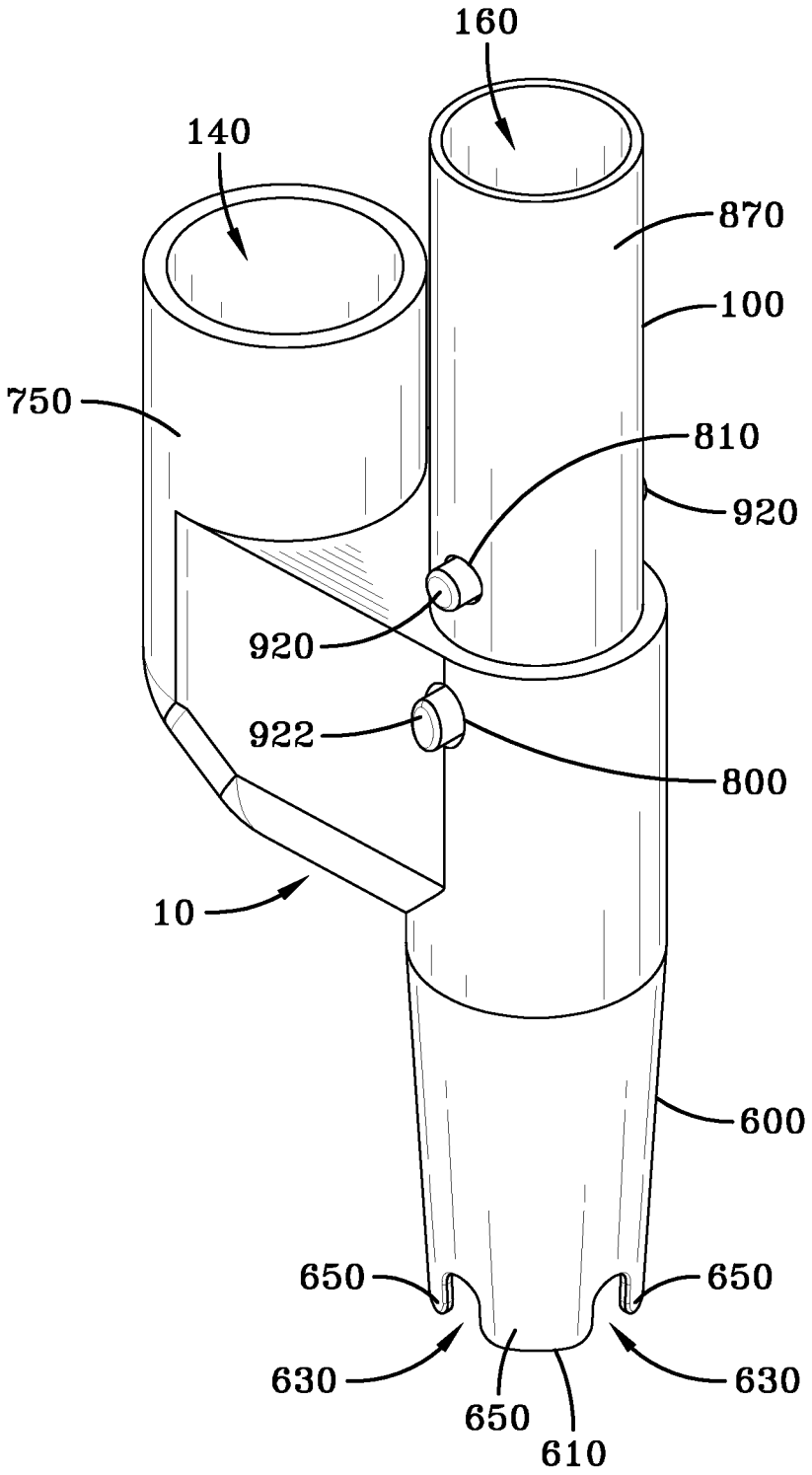
FIG. 10 is another perspective view of the cleaning accessory showing the lock member carried therein in accordance with the various embodiments disclosed herein.

It should also be appreciated that the lock apertures 800 and 810 may be configured to selectively receive spring-biased projections (not shown) carried by the pole member 300, as shown in FIGS. 9 and 10. As such, when the pole member 300 is inserted into the attachment cavity 160, the compressed spring-biased projections carried by the pole member 300 are released and extend into one or more of the lock apertures 800,810 in the attachment cavity 160. As a result, the pole member 300 is securely attached to the cleaning accessory 10.

In some embodiments, the pole member 300 may be integrated with the body 100 of the cleaning accessory 10.

It should be appreciated that in some embodiments, that the attachment segment 870, which extends from the body 100 of the cleaning accessory 10, as shown in FIGS. 5 and 6 may be received within the pole member 300, which is hollow. That is, the pole member 300 may be hollow and configured to receive the attachment segment 870 of the body 100 therein, so as to selectively attach the pole member 300 to the attachment segment 870. Furthermore, the same manner of selective attachment previously discussed above in connection with receiving the pole member 300 within the attachment cavity 160 utilizing the lock apertures 800,810 may be used in securing the attachment segment 870 within the hollow pole member 300.

Figure 7:
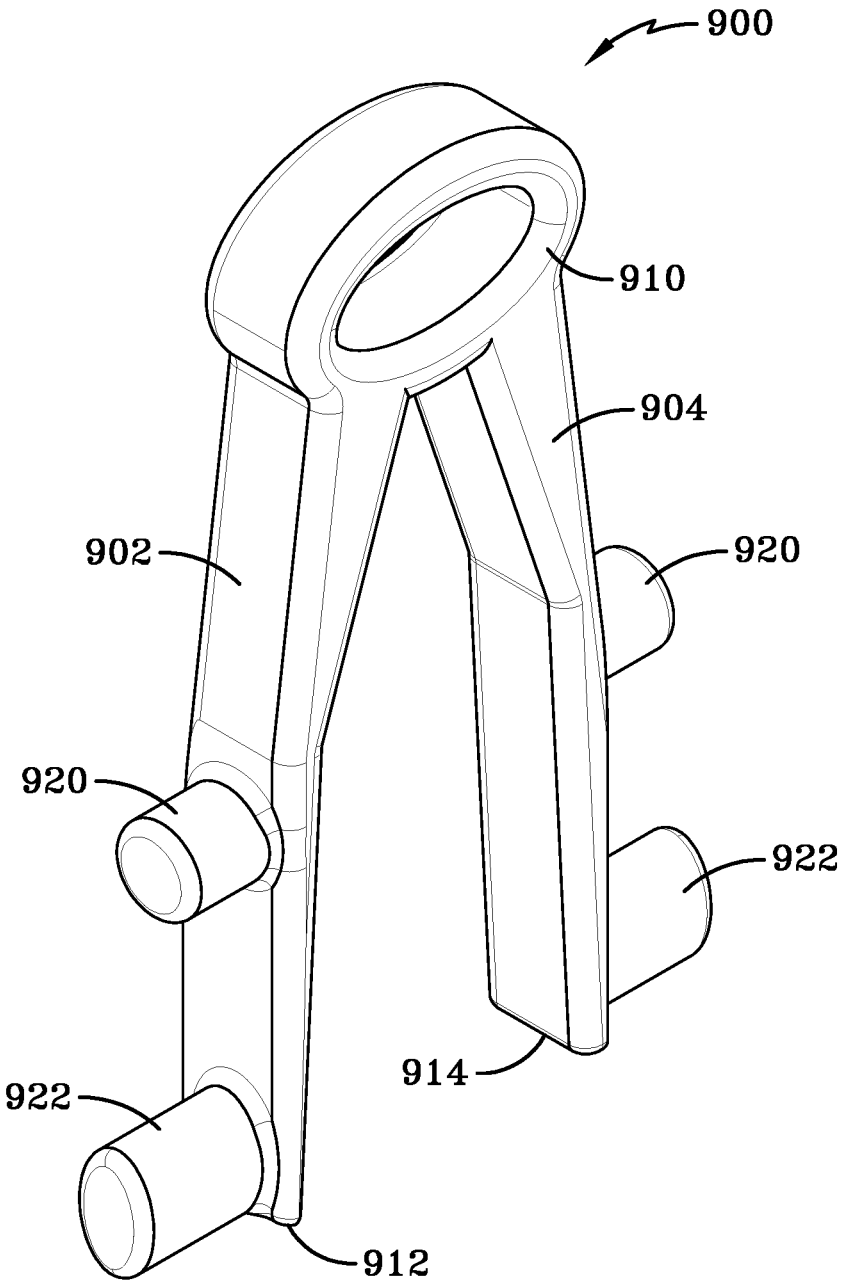
FIG. 7 is a perspective view of a lock member used to selectively attach a pole member to the cleaning accessory in accordance with the various embodiments disclosed herein.

In other embodiments, in order to selectively secure the elongated pole 300 to the cleaning accessory 10, the cleaning accessory 10 may include a lock member 900, as shown in FIG. 7. The lock member 900 may be formed of any suitable material, such as plastic, metal, composite, and the like or any combination thereof. The lock member 900 includes a pair of elongated arms 902 and 904 that extend from an anchor or base member 910 to their respective terminal ends 912 and 914. It should be appreciated that while the base member 910 is shown as a curved member having an aperture disposed therethrough, the base member 910 may comprise any desired shape, including a rectilinear shape, a curvilinear shape, or a shape that is a combination thereof. Furthermore, the base member 910 may include one or more apertures therethrough or alternatively may be a solid section. In other embodiments, the base member 910 may not be used, whereby the arms 904 and 902 are directly attached to each other at their ends that are opposite to their terminal ends 912 and 914. The elongated arms 902 and 904 are spaced apart and capable of being moved upon the application of force thereto. The arms 902 and 904 are resilient and are capable of returning to their original position after the application of force has been removed. In some embodiments, the arms 902, 904 may be arranged so that they are parallel to each other. However, the arms 902, 904 may be arranged in any manner and at any angle relative to each other, for example, they may diverge from each other or converge toward each other. Extending from each of the arms 902, 904 are a set of protrusions 920 and 922.

Figure 8:
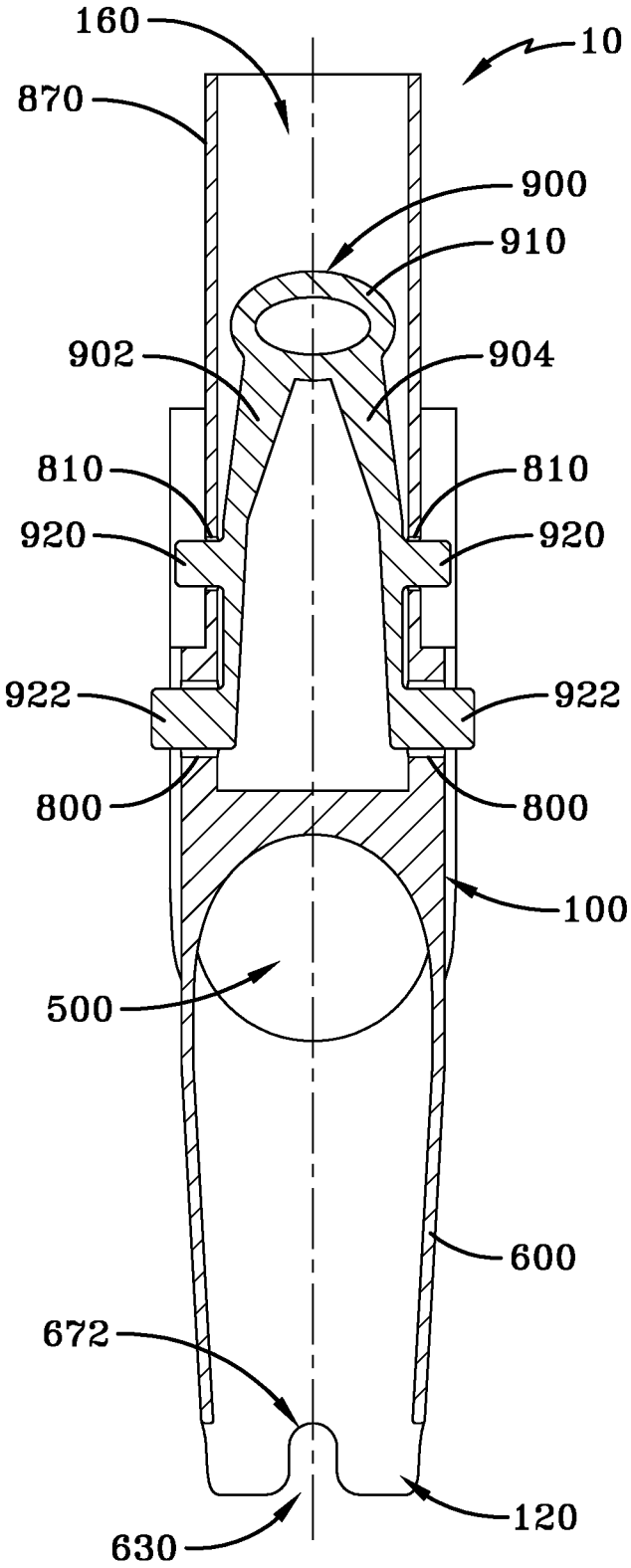
FIG. 8 is a cross-sectional view of the cleaning accessory showing the lock member in accordance with the various embodiments disclosed herein.

The lock member 900 is configured to be received and carried within the attachment cavity 160 of the attachment segment 870, as shown in FIGS. 8-10. In addition, the protrusions 920 and 922 of the lock member 900 are configured to be selectively received within respective lock apertures 800 and 810 of the body 100. As such, with the lock member 900 carried within the attachment cavity 160, the arms 902, 904 are configured to be selectively compressed by the application of a pressing force on the protrusions 922 by a user. That is, by actuating the lock member 900 by pressing the protrusions 922 inward into the lock aperture 800 and the attachment cavity 160 causes the protrusions 920 to also withdraw/retract or move inward into the lock apertures 810 and the attachment cavity 160. This allows the pole member 300 to be freely slid over the attachment segment 870. Once the pole member 300 is slid over the attachment segment 870 of the cleaning accessory 10, the user releases the force applied to the protrusions 922, whereupon the tension applied to the arms 902, 904 is released so that the protrusions 920 are free to expand back to their original position so that they extend out of the lock apertures 810 and into the attachment apertures 901 of the pole member 300. As a result, the pole member 300 is secured to the cleaning accessory 10. Alternatively, in order to release the pole member 300 from the cleaning accessory 10, the user presses the protrusions 922 to compress the arms 902, 904 inward. This retracts the protrusions 920 out of the attachment apertures 901 of the pole member 300 and into the lock apertures 801 and the attachment cavity 160 of the cleaning accessory 10, allowing the pole member 300 to be removed from the cleaning accessory 10.

Figure 9A:
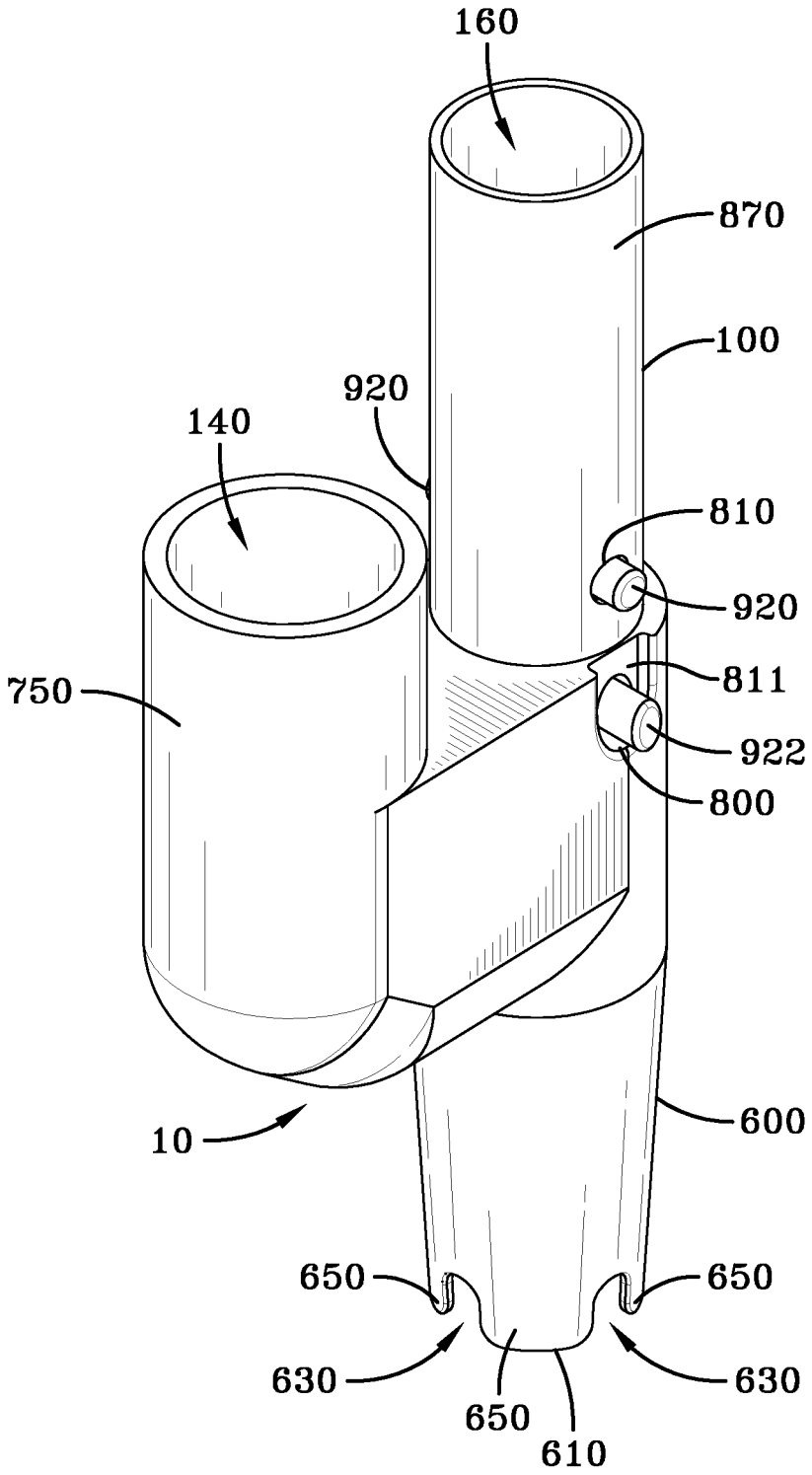
FIG. 9A is a perspective view of the cleaning accessory showing the lock aperture disposed in a recessed area in accordance with the various embodiments disclosed herein.

In other embodiments, the lock apertures 800 provided by the body 100 may be disposed in a recessed area 811 of the body 100 of the cleaning accessory 10, as shown in FIG. 9A. As such, the protrusions 922 extend through the recessed lock apertures 800, and as a result, the recessed area 811 increases the travel that the protrusions 922 move through when they are pressed by a user. This, increases the amount that the protrusions 920 retract into the lock apertures 810, increasing the ease in which the pole member 300 can be removed or attached to the cleaning accessory 10.

Figure 8A:
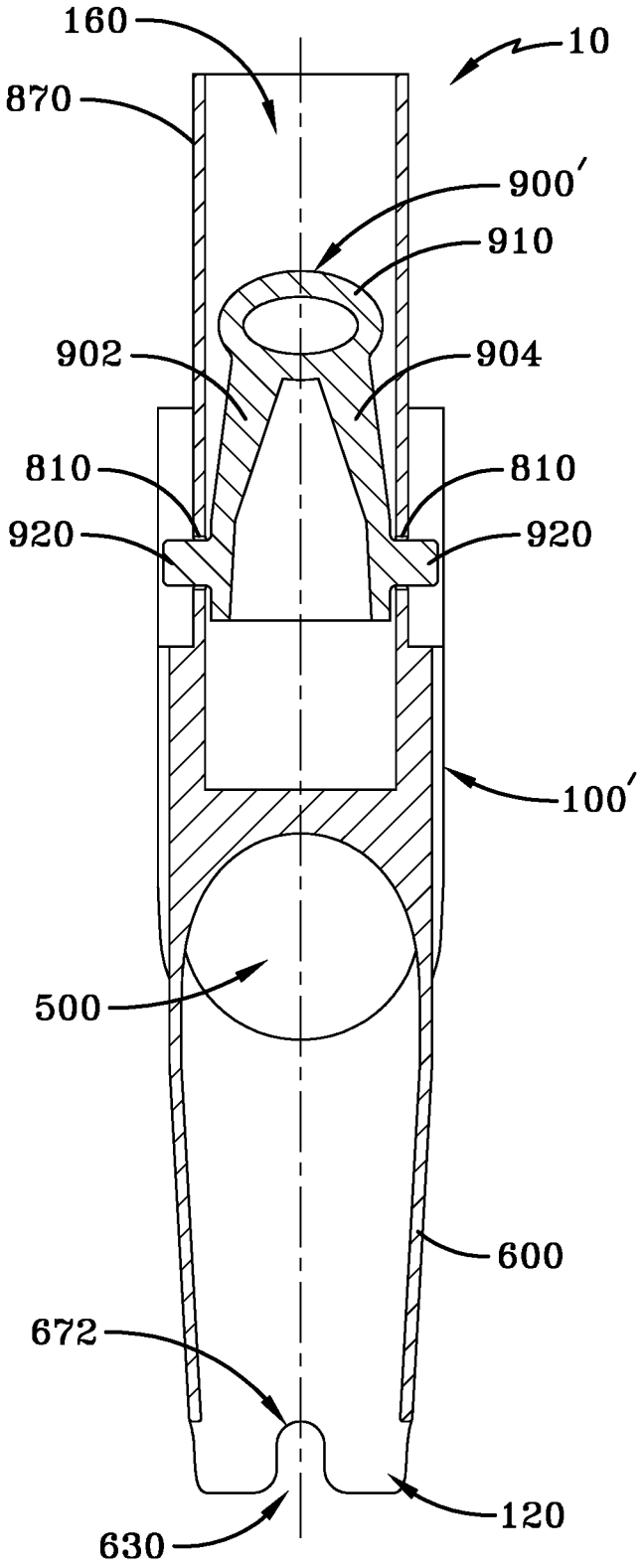
FIG. 8A is a cross-sectional view of the cleaning accessory showing an alternative lock member and body in accordance with the various embodiments disclosed herein.

In another embodiment, it is contemplated that an alternative lock member 900' may be configured to utilize only protrusions 920, as shown in FIG. 8A. That is, the arms 902, 904 of the lock member 900' are configured to only include the protrusions 920. In addition, an alternative body 100' of the cleaning accessory 10 is configured with only one set of lock apertures 810, which selectively receive the protrusions 920 of the lock member 900'. Thus, with the absence of the protrusions 922, the user is required to press the protrusions 920 inward to provide for the attachment and detachment of the pole member 300. As such, when the protrusions 920 are depressed by the user, the arms 902,904 of the lock member 900' are compressed under tension. Resultantly, the protrusions 920 resultantly move inward and retract into the lock apertures 810 and the attachment cavity 160. When the protrusions 920 are retracted into the lock apertures 810 and the attachment cavity 160, the pole member 300 is permitted to slide over the attachment segment 870 and the lock apertures 810. Upon the release of the protrusions 920 by the user, the tension on the arms 902, 904 is released, causing the protrusions 920 to move outward into the attachment apertures 901 that are in the pole member 300. As a result, the pole member 300 is locked in attachment to the cleaning accessory 10. Alternatively, in order to release the pole member 300 from the cleaning accessory 10, the user presses the protrusions 920 to compress the arms 902, 904 inward. This retracts the protrusions 920 out of the attachment apertures 901 of the pole member 300 and into the lock apertures 801 and the attachment cavity 160 of the cleaning accessory 10, allowing the pole member 300 to be removed from the cleaning accessory 10.

Continuing, it should be appreciated that the longitudinal axis of the attachment cavity/attachment segment 160, 870 may be axially aligned with the longitudinal axis of the nozzle inlet/tapered section 120, 600, as shown in the FIGS. However, the attachment cavity/attachment segment 160, 879 and the nozzle inlet/tapered section 120,600 may be arranged in any desired position or orientation. In addition, the attachment cavity 160 may be parallel with the nozzle outlet 140, but may be arranged in any desired position or orientation.

It should be appreciated that in some embodiments, the attachment segment 870 may be solid or partially solid in the case when the hollow pole member 300 receives therein the attachment segment 870, such as through a friction fit, snap fit or a threaded fit.

In some embodiments, the cleaning accessory 10 may be part of an unassembled kit. The kit may include the cleaning accessory 10 and one or more of the vacuum hose 200, the fitting or adapter 203, and the pole member 300.

It should be appreciated that the cleaning accessory 10 may be formed using any suitable manufacturing process, and may be formed as a single integral section or as a plurality of separate pieces that are configured to be attached together using any suitable means of fixation, including but not limited to adhesive, friction fit, snap fit, thread fit, and the like.

Therefore, it can be seen that the objects of the various embodiments disclosed herein have been satisfied by the structure and its method for use presented above. While in accordance with the Patent Statutes, only the best mode and preferred embodiments have been presented and described in detail, with it being understood that the embodiments disclosed herein are not limited thereto or thereby. Accordingly, for an appreciation of the true scope and breadth of the embodiments, reference should be made to the following claims.

The invention claimed is:

1. A cleaning accessory comprising:

a body having a nozzle inlet and a nozzle outlet that are fluidly coupled by a nozzle cavity; and an attachment segment extending from said body, and not in fluid communication with said nozzle cavity, wherein said nozzle cavity includes a tapered inner section having a first inner end and a second inner end, wherein said first inner end is smaller in diameter than a diameter of said second inner end, and said first inner end being defined by said nozzle inlet, and wherein said attachment segment and said nozzle inlet are axially aligned.

2. The cleaning accessory of claim 1, wherein said nozzle inlet includes an edge having at least one recessed passage, wherein said at least one recessed passage includes a curved edge.

3. The cleaning accessory of claim 2, wherein said at least one recessed passage comprises a plurality of said recessed passages that are spaced apart by a nozzle member that form said edge.

4. The cleaning accessory of claim 1, wherein said nozzle inlet is opposite to said nozzle outlet.

5. The cleaning accessory of claim 1, wherein said nozzle inlet is parallel to said nozzle outlet.

6. The cleaning accessory of claim 1, further comprising a lock member carried within an attachment cavity disposed in said attachment segment, said lock member including a plurality of protrusions configured to selectively extend through corresponding apertures disposed in a wall of said attachment segment when said lock member is actuated.

7. The cleaning accessory of claim 1, wherein said body includes a tapered outer section having a first outer end defined by said nozzle inlet and a second outer end distal to said nozzle inlet, and wherein said first outer end is smaller in diameter than a diameter of said second outer end.

8. A cleaning accessory comprising:

a body having a nozzle inlet and a nozzle outlet that are fluidly coupled by a nozzle cavity; and an attachment segment extending from said body, and not in fluid communication with said nozzle cavity, wherein said nozzle cavity includes a tapered inner section having a first inner end and a second inner end, wherein said first inner end is smaller in diameter than a diameter of said second inner end, and said first inner end being defined by said nozzle inlet, and wherein said nozzle cavity includes a plurality of right angle bends.

9. An unassembled cleaning accessory kit comprising:

a body having a nozzle inlet and a nozzle outlet that are fluidly coupled by a nozzle cavity;

an attachment segment extending from said body, and not in fluid communication with said nozzle cavity; and an attachment collar adapted to be attached at one end to a hose and said attachment collar being configured to be selectively attached at another end to the nozzle outlet, such that said hose is placed into fluid communication with said nozzle cavity, wherein said nozzle cavity includes a tapered section having a first inner end and a second inner end, wherein said first inner end is smaller in diameter than a diameter of said second inner end, and said first inner end being defined by said nozzle inlet, and wherein said attachment segment and said nozzle inlet are axially aligned.

10. The kit of claim 9, wherein said nozzle inlet includes an edge having at least one recessed passage.

11. The kit of claim 10, wherein said at least one recessed passage comprises a plurality of said recessed passages that are spaced apart by a nozzle member that form said edge.

12. The kit of claim 9, wherein said nozzle inlet is opposite to said nozzle outlet.

13. The kit of claim 9, wherein said nozzle inlet is parallel to said nozzle outlet.

14. The kit of claim 9, further comprising a lock member carried within an attachment cavity disposed in said attachment segment, said lock member including a plurality of protrusions configured to selectively extend through corresponding apertures disposed in a wall of said attachment segment when said lock member is actuated.

15. The kit of claim 9, wherein said body includes a tapered outer section having a first outer end defined by said nozzle inlet and a second outer end distal to said nozzle inlet, and wherein said first outer end is smaller in diameter than a diameter of said second outer end.

16. An unassembled cleaning accessory kit comprising:

a body having a nozzle inlet and a nozzle outlet that are fluidly coupled by a nozzle cavity;

an attachment segment extending from said body, and not in fluid communication with said nozzle cavity; and an attachment collar adapted to be attached at one end to a hose and said attachment collar being configured to be selectively attached at another end to the nozzle outlet, such that said hose is placed into fluid communication with said nozzle cavity, wherein said nozzle cavity includes a tapered section having a first inner end and a second inner end, wherein said first inner end is smaller in diameter than a diameter of said second inner end, and said first inner end being defined by said nozzle inlet, and wherein said nozzle cavity includes a plurality of right angle bends.

* * * * *